US006568929B2

(12) United States Patent
Takagi

(10) Patent No.: US 6,568,929 B2
(45) Date of Patent: May 27, 2003

(54) TROCHOID GEAR PUMP HAVING MEANS FOR CANCELING IMBALANCE LOAD

(75) Inventor: Masatoshi Takagi, Takahama (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/086,847

(22) Filed: Mar. 4, 2002

(65) Prior Publication Data

US 2002/0122736 A1 Sep. 5, 2002

(30) Foreign Application Priority Data

Mar. 5, 2001 (JP) ..... 2001-059370

(51) Int. Cl.[7] ..... F04C 2/10
(52) U.S. Cl. ..... 418/71; 418/171
(58) Field of Search ..... 418/71, 73, 171

(56) References Cited

U.S. PATENT DOCUMENTS 3,188,969 A * 6/1965 Brundage ..... 418/73
RE27,228 E * 11/1971 Brundage ..... 418/71
3,680,989 A * 8/1972 Brundage ..... 418/71
3,834,842 A * 9/1974 Dorff et al. ..... 418/71
4,493,620 A 1/1985 Takei et al. ..... 417/366
4,820,138 A * 4/1989 Bollinger ..... 418/71

FOREIGN PATENT DOCUMENTS

JP 2000-161241 6/2000

* cited by examiner

*Primary Examiner*—John J. Vrablik
(74) *Attorney, Agent, or Firm*—Nixon & Vanderhye P.C.

(57) ABSTRACT

A trochoid pump composed of an inner gear and an outer gear is used as a fluid pump such as a fuel pump for an automotive vehicle. An inner imbalance load inherently developing in the pumping chambers is suppressed or canceled by an outer imbalance load generated by pressurizing fluid introduced into blade ditches formed on an outer periphery of the outer gear. Positions of a pressure-introducing port and a pressure-releasing port for the blade ditches are selected so that the outer imbalance load is imposed in a direction opposing the inner imbalance load. An amount of the outer imbalance load is made equal to an amount of the inner imbalance load to eliminate undesirable effects of the inner imbalance load.

5 Claims, 8 Drawing Sheets

TROCHOID GEAR PUMP HAVING MEANS FOR CANCELING IMBALANCE LOAD

CROSS-REFERENCE TO RELATED APPLICATION

This application is based upon and claims benefit of priority of Japanese Patent Application No. 2001-59370 filed on Mar. 5, 2001, the content of which is incorporated herein by reference.

BACKGROUND OF THE INVENTION

1. Field of the Invention

The present invention relates to a trochoid gear pump for pumping up fluid such as fuel to be supplied to an internal combustion engine, and more particularly to such a trochoid gear pump in which imbalance pressure generated therein is canceled.

2. Description of Related Art

Recently, a study to use a trochoid gear pump as a fuel pump for supplying fuel into an internal combustion engine is being made in order to improve pumping ability of the fuel pump. As shown in FIG. 11, the trochoid gear pump is composed of an outer gear 2 rotatably supported in an inner bore of a pump casing 1 and an inner gear 3 disposed in an eccentric relation to the outer gear 2. Pumping chambers 4 are formed between outer teeth of the inner gear 3 and inner teeth of the outer gear 2. The inner gear 3 is driven by a motor and the outer gear 2 rotates according to rotation of the inner gear 3, and thereby a volume of the pumping chambers is continuously changed. According to rotation of the trochoid gear pump, fuel is pumped up from a fuel tank and supplied to an internal combustion engine.

The fuel is sucked into the trochoid gear pump in a angular region where the volume of the pumping chambers 4 increases, and the sucked fuel is pressurized and pumped out in a angular region where the volume of the pumping chambers 4 decreases. Since the fuel pressure in the pumping chambers 4 increases in the region where the pumping chamber volume decreases, a load for outwardly pushing the outer gear 2 is generated in the pumping chambers 4. On the other hand, this load is not generated in the region where the pumping chamber volume increases. In other words, the load outwardly pushing the outer gear 2 only appears in the angular region where the fuel is pressurized. Accordingly, an inner imbalance load pressing the outer gear 2 against an inner bore of the pump casing 1 is generated in a direction shown by an arrow in FIG. 11. The outer periphery of the outer gear 2 is strongly pressed against the inner bore of the pump casing 1 by this inner imbalance load. This increases abrasion between the pump casing 1 and the outer gear 2, and thereby a higher driving torque is required. Accordingly, the pumping efficiency decreases and an operating life of the pump is shortened due to the abrasion.

To overcome the above-described problem, JP-A-2000-161241 proposes an improved structure of the trochoid gear pump. A relevant portion in the proposed structure is shown in FIG. 12. Fuel is sucked through an inlet port 5 and pressurized fuel in the pump is pumped out from an outlet port 6. A pressure-supplying groove 7 is formed on the inner bore of the pump casing 1 in the region where the fuel is pressurized and pumped out. The pressure-supplying groove 7 is connected to the outlet port 6 to introduce fuel pressure into the pressure-supplying groove 7. The outer periphery of the outer gear 2 is inwardly pushed by the fuel pressure introduced into the pressure-supplying groove 7. This proposed structure intends to cancel the inner imbalance load generated in the pumping chambers 4 by the pressure introduced into the pressure-supplying groove 7 and to decrease abrasion between the pump casing 1 and the outer gear 2.

It is found out, however, that the fuel pressure introduced into the pressure-supplying groove 7 does not impose a sufficient pressure on the outer periphery of the outer gear 2 to cancel the inner imbalance load generated in the pumping chambers 4. This is because the pressure in the pressure-supplying groove 7 leaks out through a clearance between the outer periphery of the outer gear 2 and the inner bore of the casing 1. Further, the pump efficiency decreases because the outlet pressure leaks toward the inlet port 5.

SUMMARY OF THE INVENTION

The present invention has been made in view of the above-mentioned problem, and an object of the present invention is to provide an improved trochoid gear pump in which the abrasion between the outer gear and the pump casing is surely decreased and thereby to realize a high efficiency and a high reliability of the trochoid gear pump.

A trochoid gear pump having an inner gear and an outer gear is used as a fluid pump such as a fuel pump for pumping up fuel from a fuel tank and supplying pressurized fuel to an internal combustion engine. The trochoid gear pump is driven by an electric motor, and the outer gear is rotatably supported in an inner bore of a cylindrical pump casing. In pumping operation of the trochoid gear pump, an inner imbalance load is generated in a pressuring angular region of the trochoid gear pump. The inner imbalance load is imposed on an inner periphery of the outer gear in a certain direction, pushing the outer gear against the inner bore of the pump casing.

Plural blade ditches are formed around a cylindrical outer periphery of the outer gear to generate an outer imbalance load which cancels at least a part of the inner imbalance load. Liquid such as fuel introduced into the blade ditches through a pressure-introducing port is pressurized in the blade ditches, and the pressurized fuel is released through a pressure-releasing port. Both the pressure-introducing port and the pressure-releasing port are positioned on the inner bore of the pump casing so that the outer imbalance load is generated at angular position substantially opposing against the inner imbalance load.

Preferably, the positions of both of the pressure-introducing port and the pressure-releasing port are selected so that the direction of the outer imbalance load exactly opposes to the direction of the inner imbalance load. Further, the blade ditches are so designed that an amount of the outer imbalance load generated in the blade ditches becomes equal to an amount of the inner imbalance load. In this manner, the inner imbalance load is fully canceled by the outer imbalance load, thereby reducing abrasion between the outer periphery of the outer gear and the inner bore of the pump casing and attaining a high pumping efficiency and a high reliability of the trochoid gear pump.

Passages for leading fluid to the pressure-introducing port and for releasing the pressurized fuel from the pressure-releasing port may be formed on side covers covering both sides of the inner and outer gears. The blade ditches may be formed in a zigzag arrangement around the outer periphery of the outer gear to make a volume of each blade ditch small thereby to reduce noises generated in a fluid flow.

According to the present invention, the inner imbalance load inherently developing in the trochoid pump is substantially canceled by the outer imbalance load generated by introducing fluid pressure to the outer periphery of the outer gear, and thereby a high efficiency and a high reliability of the trochoid gear pump are realized.

Other objects and features of the present invention will become more readily apparent from a better understanding of the preferred embodiment described below with reference to the following drawings.

DETAILED DESCRIPTION OF THE PREFERRED EMBODIMENT

Figure 1:
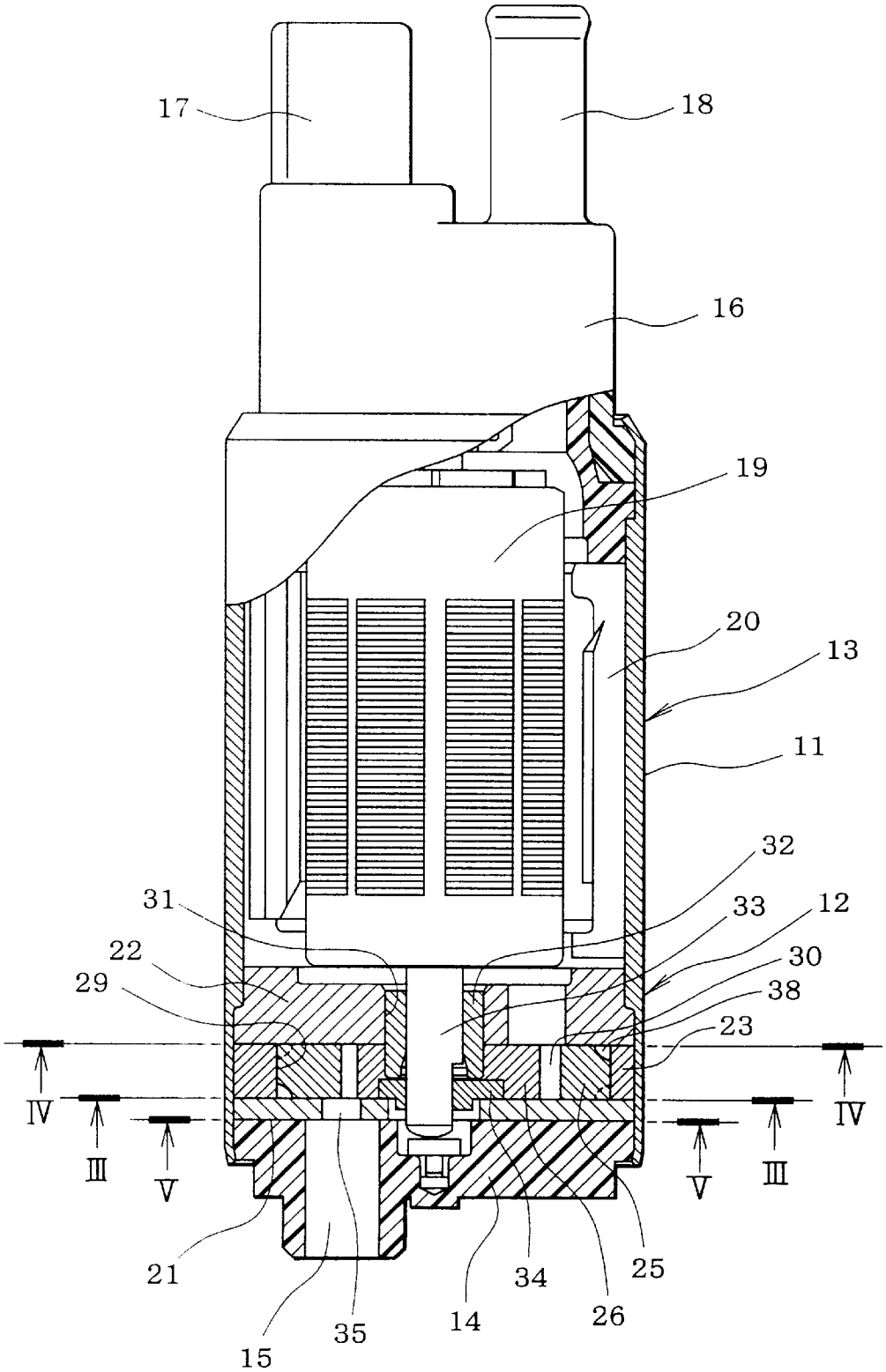
FIG. 1 is a drawing showing an entire structure of a fuel pump, partly cross-sectioned, according to the present invention.
Figure 2:
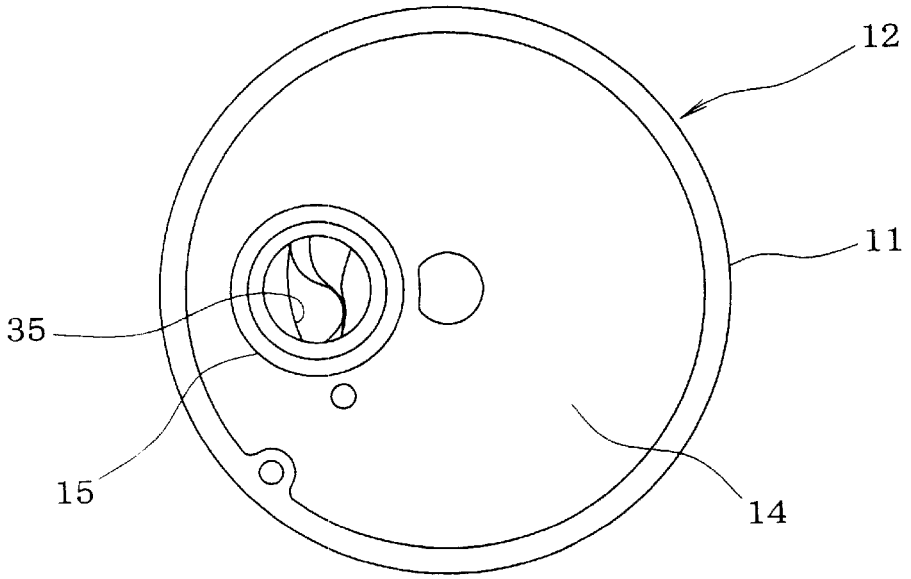
FIG. 2 is a plan view showing a bottom end of the fuel pump shown in FIG. 1.

A preferred embodiment of the present invention will be described with reference to FIGS. 1–10. A trochoid gear pump 12 is used as a fuel pump for supplying fuel to an internal combustion engine. First, referring to FIGS. 1 and 2, an entire structure of the fuel pump will be briefly described. A trochoid gear pump 12 driven by an electric motor 13 is contained in a housing 11. A pump cover 14 covering the trochoid gear pump 12 is connected to a bottom end of the housing 11. An inlet pipe 15 from which fuel is sucked from a fuel tank into the trochoid gear pump 12 is formed integrally with the pump cover 14. A motor cover 16 covering the motor 13 is connected to an upper end of the housing 11. An outlet pipe 18 from which fuel pressurized by the trochoid gear pump 12 is delivered to outside and a connector 17 for supplying driving current to the motor 13 are formed integrally with the motor cover 16. Fuel pumped out from the trochoid gear pump 12 flows through a gap between an armature 19 and a magnet 20 and is delivered to outside from the outlet pipe 18.

Figure 3:
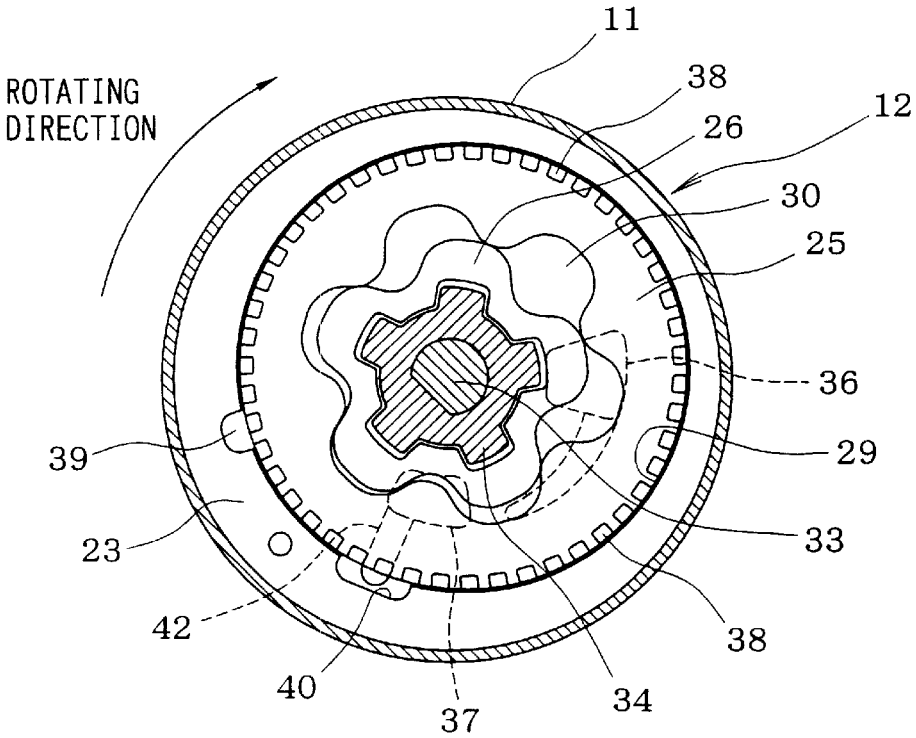
FIG. 3 is a cross-sectional view showing a trochoid gear pump used in the fuel pump, taken along line III—III shown in FIG. 1.

Now, a structure of the trochoid gear pump 12 will be described in detail. As shown in FIG. 1, a cylindrical pump casing 23 is sandwiched between a disc-shaped upper side cover 22 and a disc-shaped lower side cover 21. The pump casing 23 and both side covers 21, 22 are connected together by screws (not shown), forming a pump housing. Inside the pump housing, an outer gear 25 and an inner gear 26 are disposed. As shown in FIG. 3, plural outer teeth are formed on the outer periphery of the inner gear 26, and plural inner teeth are formed on the inner periphery of the outer gear 25. Both of the outer teeth and the inner teeth are trochoid-shaped, and the number of the outer teeth formed on the inner gear 26 is less than the number of the inner teeth formed on the outer gear 25 by one.

The outer gear 25 is rotatably disposed in an inner bore of the pump casing 23, the inner bore being formed in an eccentric relation with respect to a center of the cylindrical pump casing 23. The inner gear 26 is eccentrically disposed inside the outer gear 25 so that a plurality of pumping chambers 30 are formed between the inner teeth of the outer gear 25 and the outer teeth of the inner gear 26. Since the outer gear 25 and the inner gear 26 are disposed in an eccentric relation to each other, a volume of respective pumping chambers 30 continuously increases and decreases when the pump is driven by the motor 13. The volume change in the pumping chambers 30 is repeated every rotation, thereby performing a pumping action.

As shown in FIG. 1, a cylindrical bearing 32 is press-fitted in a through-hole 31 formed in the center of the upper side cover 22. A motor shaft 33 of the motor 13 is rotatably supported in the cylindrical bearing 32, and the inner gear 26 is rotatably supported by an outer periphery of the cylindrical bearing 32. The bottom end portion of the motor shaft 33 is D-shaped as shown in FIG. 3, and a coupling 34 is fixed to the D-shaped portion. The coupling 34 engages with an inner hole of the inner gear 26. The inner gear 26 is driven by the motor shaft 33, and the outer gear 25 is rotated according to rotation of the inner gear 26.

Figure 4:
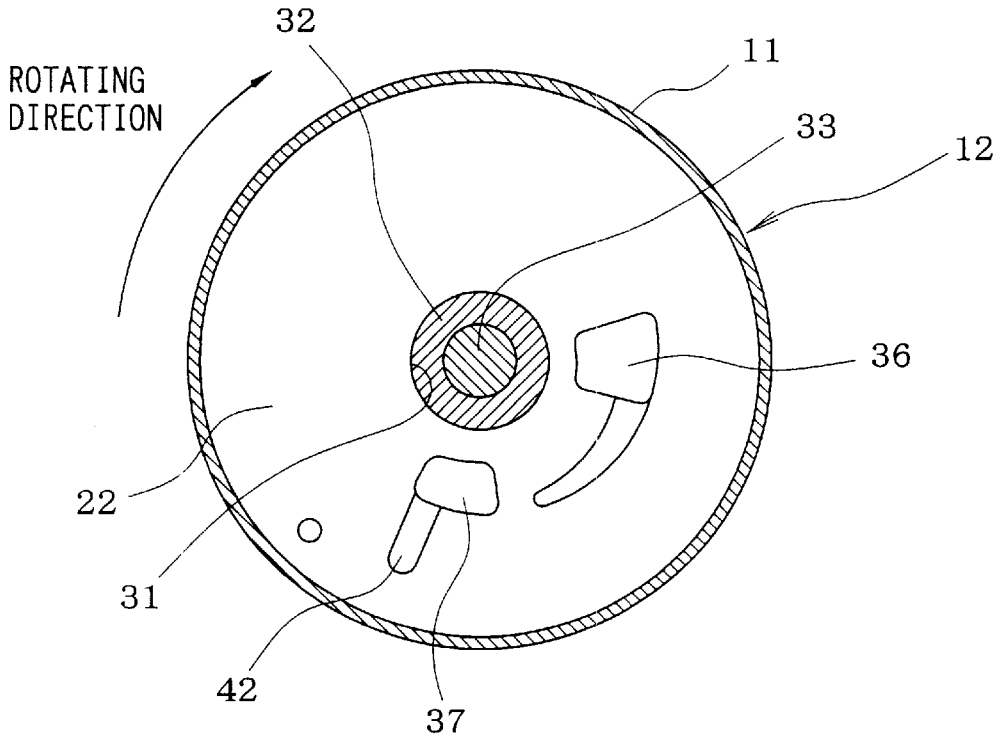
FIG. 4 is a cross-sectional view showing an upper side cover of the trochoid gear pump, taken along line IV—IV shown in FIG. 1.
Figure 5:
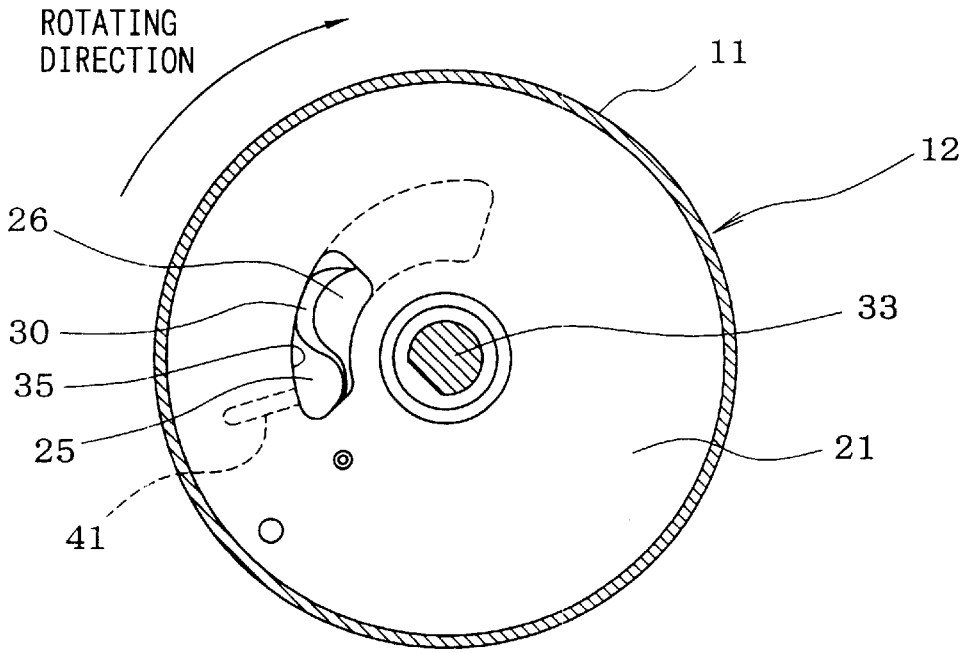
FIG. 5 is a cross-sectional view showing a lower side cover of the trochoid gear pump, taken along line V—V shown in FIG. 1.

As shown in FIGS. 1 and 5, an inlet port 35 from which fuel in a fuel tank is sucked into the trochoid gear pump 12 is formed through the lower side cover 21. The inlet port 35 is formed in a region where the volume of the pumping chambers 30 increases (referred to as an inlet region). As shown in FIGS. 1 and 4, two outlet ports 36 and 37 from which pressurized fuel is pumped out are formed through the upper side cover 22. The outlet ports 36, 37 are formed in a region where the volume of the pumping chambers 30 decreases (referred to as an outlet region). The fuel pumped out from the outlet ports 36, 37 flows through a peripheral gap between the armature 19 and the magnet 20 and flows out through the outlet pipe 18.

Figure 6:
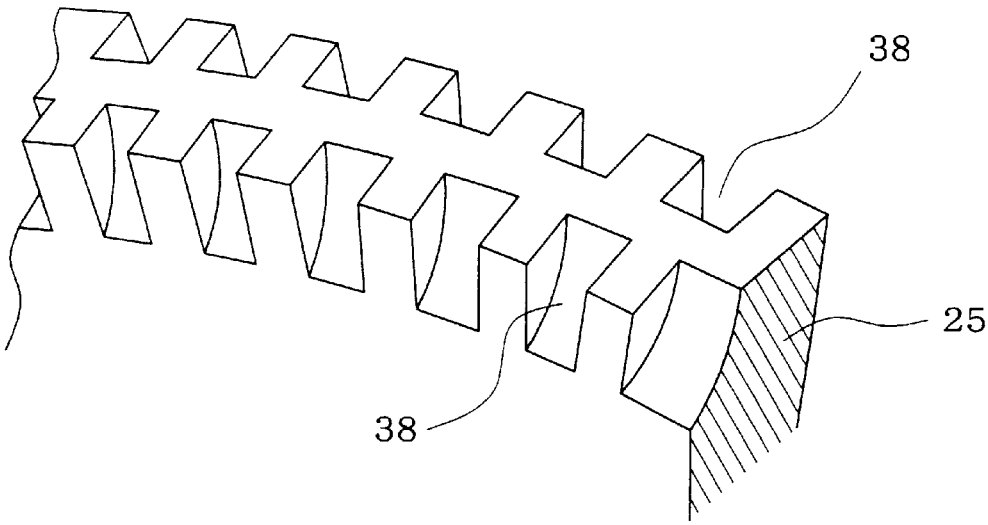
FIG. 6 is a perspective view showing blade ditches formed on an outer periphery of an outer gear of the trochoid gear pump.

As shown in FIGS. 3 and 6, blade ditches 38 are formed along the outer periphery of the outer gear 25 in an zigzag arrangement. On an inner periphery of the pump casing 23, a pressure-introducing port 39 from which fuel is introduced into the blade ditches 38 and a pressure-releasing port 40 from which pressurized fuel by the blade ditches 38 is released are formed. The pressure-introducing port 39 and the pressure-releasing port 40 are formed apart from each other with a predetermined angular interval.

The pressure-introducing port 39 communicates with a pressure-introducing passage 41 (refer to FIG. 5) which is formed on an upper surface of the lower side cover 21, extending from the inlet port 35. A part of fuel sucked through the inlet port 35 is introduced into the pressure-introducing port 39 through the pressure-introducing passage 41. The pressure-releasing port 40 communicates with a pressure releasing-passage 42 (refer to FIG. 4) which is formed on an lower surface of the upper side cover 22, extending from the outlet port 37 (one of the outlet ports located at a higher pressure side). Fuel pressurized in the blade ditches 38 is released to the outlet port 37 through the pressure-releasing passage 42.

Figure 7:
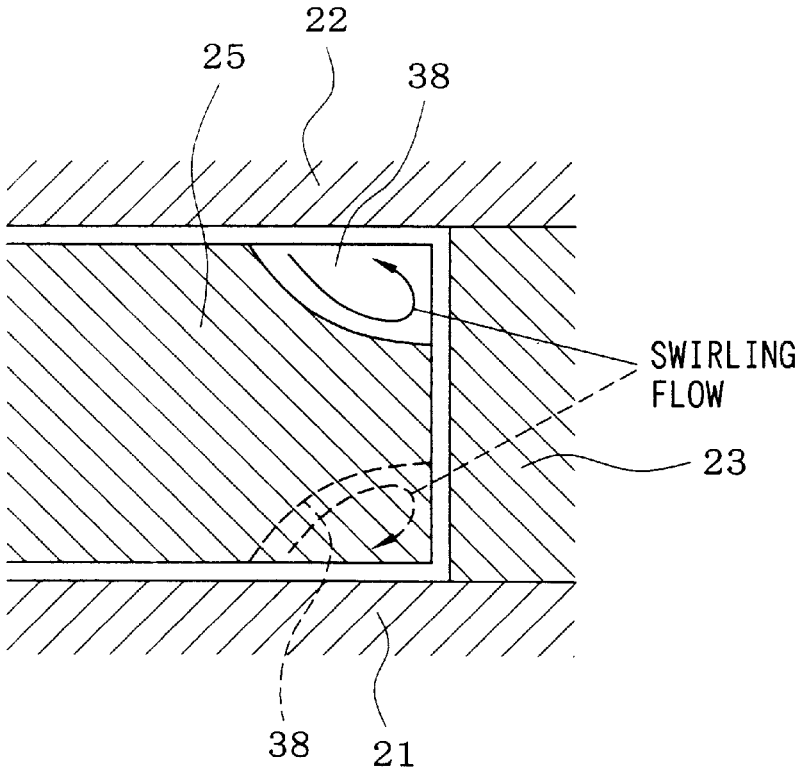
FIG. 7 is an enlarged view showing details of the blade ditches and a swirling fuel flow formed in the blade ditches.

The blade ditches 38 formed on the outer periphery of the outer gear 25 functions as a turbine pump and pressurizes fuel therein. The blade ditches 38 also generates a swirling flow of fuel therein as shown in FIG. 7, which prevents pressure leakage. Fuel pressure is generated around the outer periphery of the outer gear 25, as explained below with reference to FIGS. 8–10.

Figure 8:
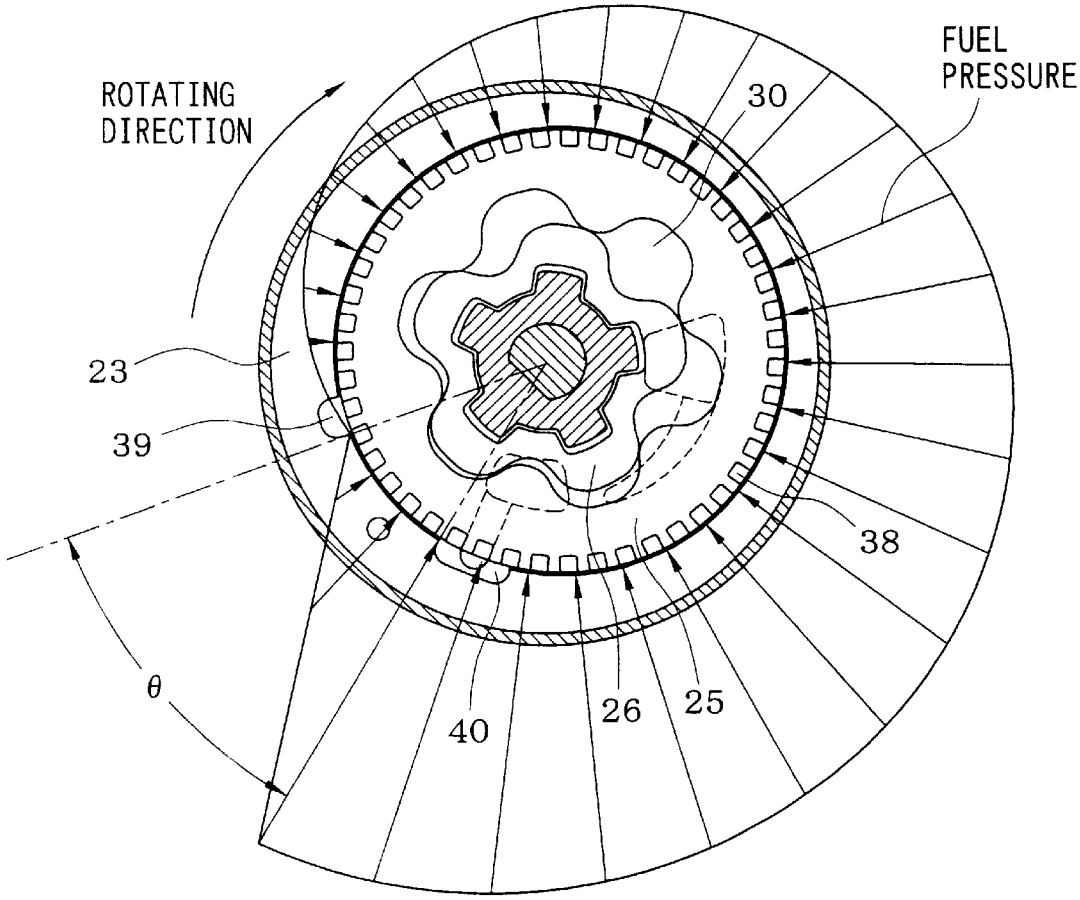
FIG. 8 is a schematic view showing a distribution of fuel pressure generated around an outer periphery of an outer gear of the trochoid gear pump.

As shown in FIG. 8, the pressure around the outer periphery of the outer gear 25 (referred to as an outer pressure) gradually increases in a region from the pressure-introducing port 39 to the pressure-releasing port 40. The outer pressure is zero at the pressure-introducing port 39 and reaches its maximum level at the pressure-releasing port 40. The outer pressure reached the maximum level at the pressure-releasing port 40 is decreased to zero in a sealing portion (having a seal angle θ) from the pressure-releasing port 40 to the pressure-introducing port 39.

Figure 10:
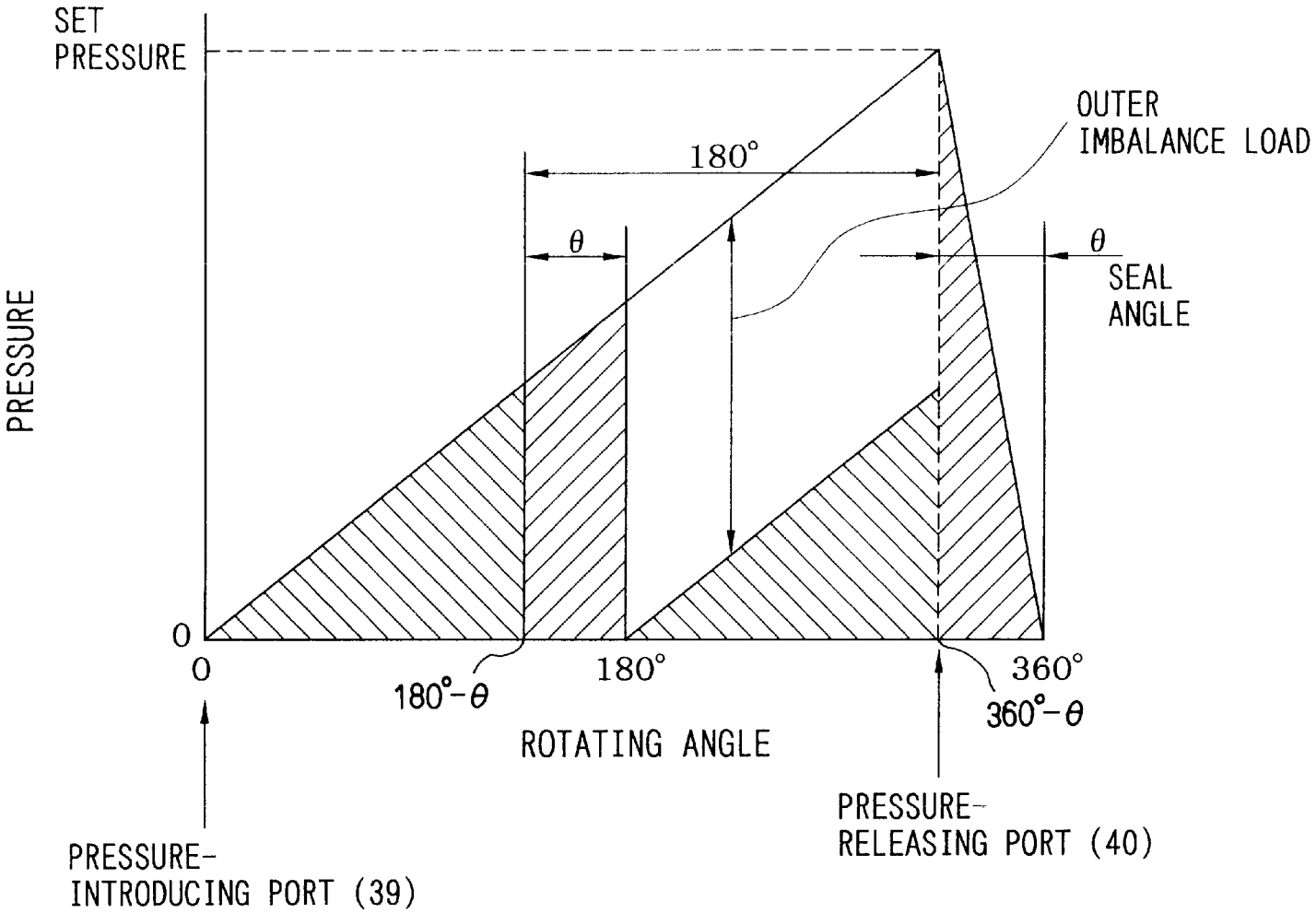
FIG. 10 is a graph showing a distribution of fuel pressure generated around an outer periphery of an outer gear.
Figure 11:
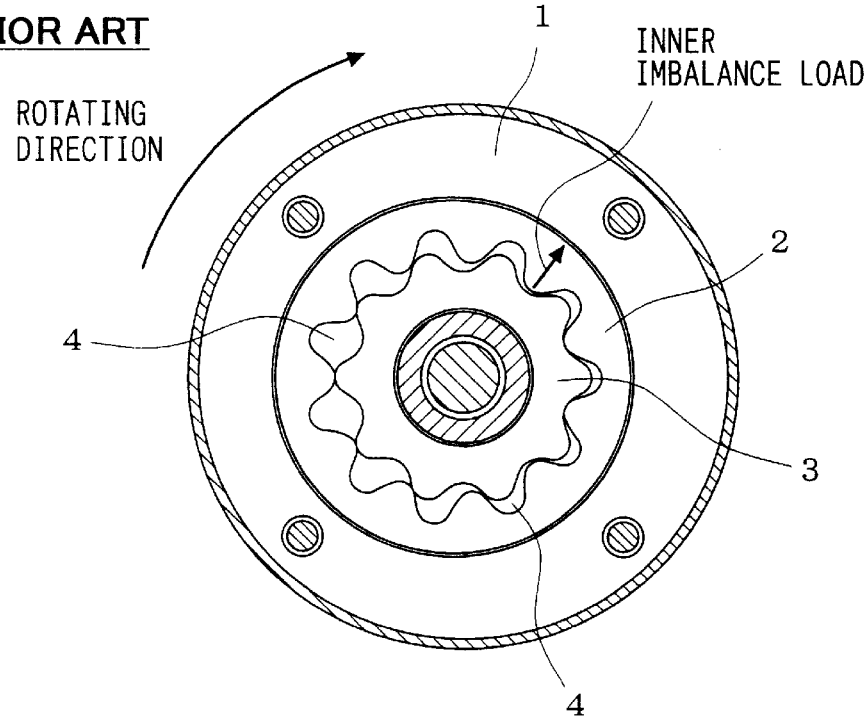
FIG. 11 PRIOR ART
FIG. 11 is a cross-sectional view showing a portion of a conventional trochoid gear pump.
Figure 12:
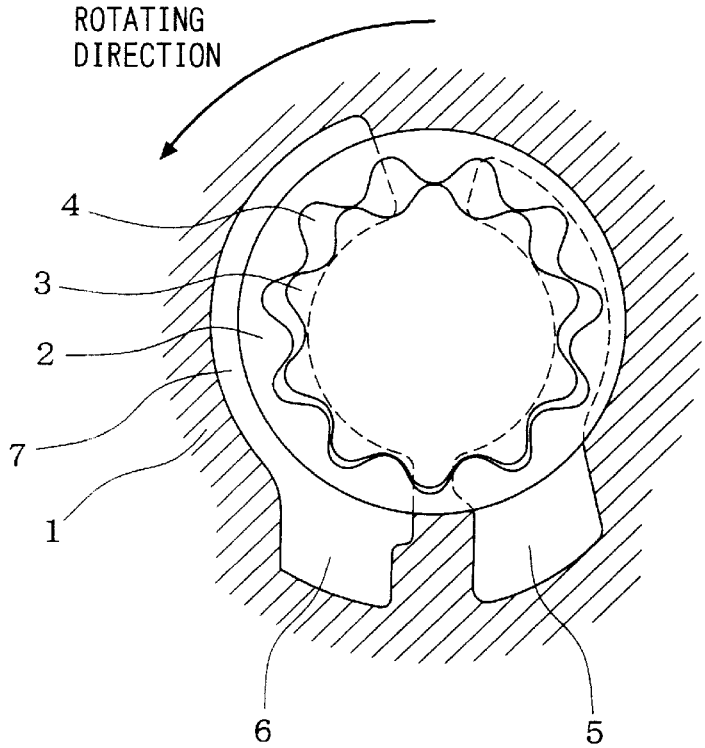
FIG. 12 PRIOR ART
FIG. 12 is a cross-sectional view showing a portion of a conventional trochoid gear pump in which a pressure-supplying groove is formed.

The fuel pressure applied to each position of the outer periphery of the outer gear 25 is decreased or canceled by a pressure applied to a 180-degree opposing position. Accordingly, as shown in FIG. 10, the outer pressure applied in a region from a position of rotating angle zero (the position of the pressure-introducing port 39) to a position of rotating angle (180−θ) is canceled by, or balanced with, the outer pressure applied in a region from a position of rotating angle 180 to a position of rotating angle (360−θ) which is the position of the pressure-releasing port 40. Similarly, the outer pressure applied in a region from a position of rotating angle (180−θ) to a position of rotating angle 180 is canceled by the outer pressure applied in a region from a position of rotating angle (360−θ) to a position of rotating angel 360. As a result, the effective outer pressure (not canceled) is almost equally applied to the outer periphery of the outer gear 25 only in the region of rotating angle 180 to (360−θ).

Figure 9:
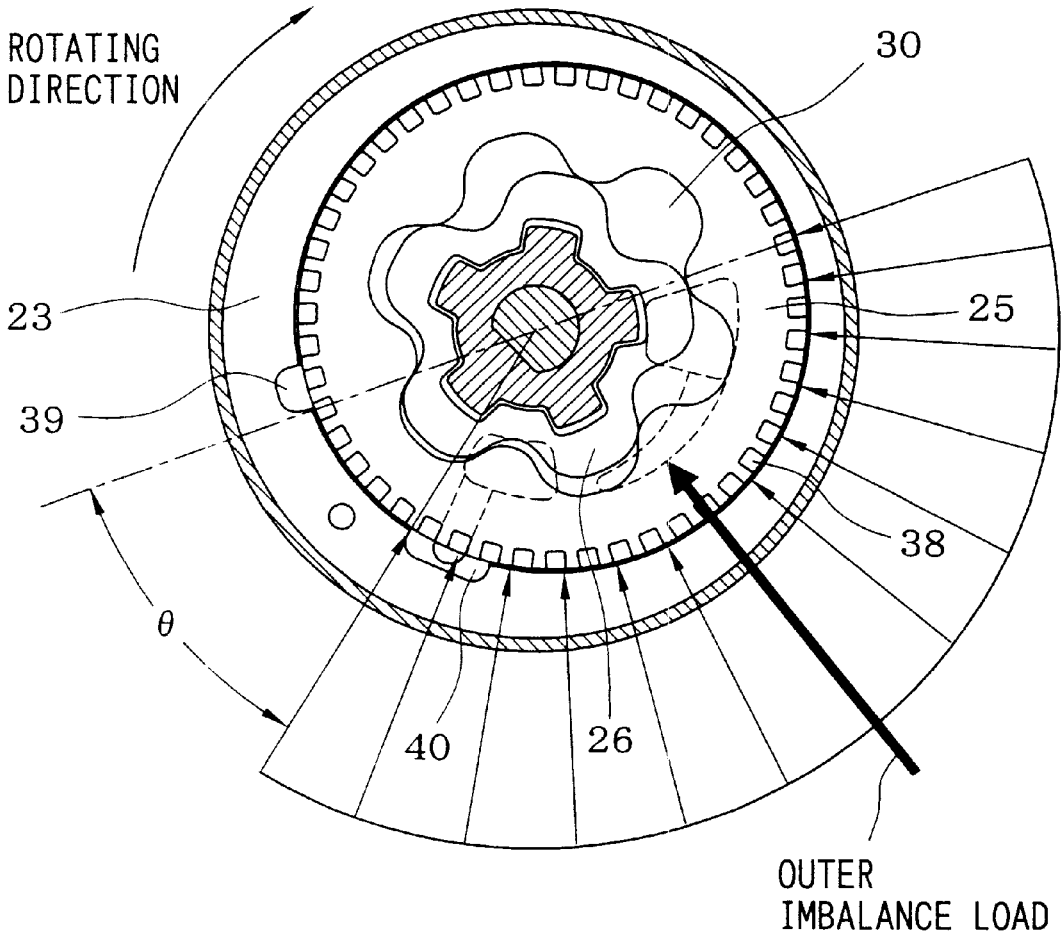
FIG. 9 is a schematic view showing a direction of an outer imbalance load imposed on the outer periphery of the outer gear.

FIG. 9 shows such effective outer pressure applied to the outer periphery of the outer gear 25 in the region from the position of rotating angle 180 to the position of rotating angle (360−θ). This effective outer pressure is applied to the outer gear 25 in a direction shown by a thick arrow in FIG. 9. Since the outer pressure is applied to the outer gear 25 only in a particular direction, the outer pressure generates an imbalance load imposed on the outer periphery of the outer gear 25, and accordingly this is referred to as an outer imbalance load. The imbalance load is applied to the outer gear 25 at a center of a region from rotating angle 180 to rotating angle (360−θ) and is directed toward the center of the outer gear 25. Therefore, the direction of the outer imbalance load is determined by the positions of the pressure-introducing port 39 and the pressure-releasing port 40.

An inner imbalance load is generated by an uneven fuel pressure developed in the pumping chambers 30 of the trochoid gear pump 12, as explained above. The direction of the outer imbalance load is set to the direction opposing a direction of the inner imbalance load, so that the inner imbalance load is canceled, or at least suppressed, by the outer imbalance load. In the embodiment described above, the blade ditches 38 are so designed that an amount of the outer imbalance load becomes equal to an amount of the inner imbalance load to fully eliminate the undesirable effects of the inner imbalance load.

Since the inner imbalance load imposed on the inner periphery of the outer gear 25 is substantially canceled by the outer imbalance load imposed on the outer periphery of the outer gear 25, it is possible to keep the outer gear 25 under a floating condition with a small gap apart from the inner bore of the pump casing 23, or under a condition where the outer gear 25 slightly contacts the inner bore of the pump casing 23. In this manner, abrasion between the outer periphery of the outer gear 25 and the inner bore of the pump casing 23 can be minimized, and thereby a high pumping efficiency and a high reliability of the trochoid pump are realized. Further, the outer gear 25 and the pump casing 23 may be made from a resin material because the abrasion therebetween is considerably reduced, thereby achieving a low cost and a light weight.

Though the inner imbalance load is fully canceled by the outer imbalance load in the foregoing embodiment, it is, of course, possible to partially cancel the inner imbalance load to suppress the abrasion. Since the blade ditches 38 are formed on the outer periphery of the outer gear 25 in a zigzag arrangement in the embodiment described above, a capacity of each blade ditch 38 is made small, and thereby noises occurring when fuel in the blade ditches 38 hits an inner wall of the pressure-releasing port 40 are suppressed. However, the design and the arrangement of the blade ditches may be variously modified. The present invention may be applied to other pumps than the trochoid pump by modifying its form to meet respective needs.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A trochoid gear pump for sucking fluid from an inlet port and delivering fluid from an outlet port, the trochoid gear pump comprising:

an inner gear having trochoid outer teeth formed on an outer periphery thereof, the inner gear being adapted to be rotated;

an outer gear having trochoid inner teeth formed on an inner periphery thereof and a cylindrical outer periphery;

a cylindrical pump casing having an inner bore, the cylindrical outer periphery of the outer gear being rotatably supported in the inner bore of the cylindrical pump casing, so that the trochoid inner teeth of the outer gear rotatably contact the trochoid outer teeth of the inner gear in an eccentric relation, forming pumping chambers between the inner teeth and the outer teeth;

a plurality of blade ditches formed on the cylindrical outer periphery of the outer gear;

a pressure-introducing port, formed on the inner bore of the pump casing, communicating with the blade ditches;

a pressure-releasing port, formed on the inner bore of the pump casing, communicating with the blade ditches; wherein:

the fluid introduced into the blade ditches is pressurized to generate an outer imbalance load imposed on the cylindrical outer periphery of the outer gear; and the pressure-introducing port and the pressure-releasing port are so positioned on the inner bore of the pump casing that the outer imbalance load cancels at least part of an inner imbalance load generated in the pumping chambers and imposed on the inner periphery of the outer gear.

2. The trochoid gear pump as in claim 1, wherein:

the outer imbalance load is imposed on the cylindrical outer periphery of the outer gear in a direction substantially opposite to a direction in which the inner imbalance load is imposed on the inner periphery of the outer gear.

3. The trochoid gear pump as in claim 2, wherein:

an amount of the outer imbalance load is substantially equal to an amount of the inner imbalance load.

4. The trochoid gear pump as in claim 1, further including a lower side cover and an upper side cover, both covering sides of the inner gear and the outer gear, wherein:

the pressure-introducing port is connected to the inlet port through a pressure-introducing passage formed on the lower side cover; and the pressure-releasing port is connected to the outlet port through a pressure-releasing passage formed on the upper side plate.

5. The trochoid gear pump as in claim 1, wherein:

the plurality of blade ditches are formed on the cylindrical outer periphery of the outer gear in a zigzag arrangement.

* * * * *